US009818322B2

(12) United States Patent
Wei et al.

(10) Patent No.: US 9,818,322 B2
(45) Date of Patent: Nov. 14, 2017

(54) METHOD AND SYSTEM FOR OBTAINING COLOR MEASUREMENT OF A DISPLAY SCREEN

(71) Applicant: DATACOLOR HOLDING AG, Lucerne (CH)

(72) Inventors: Hong Wei, Princeton, NJ (US); Colman F. Shannon, Lawrenceville, NJ (US)

(73) Assignee: DATACOLOR HOLDING AG, Luzern (CH)

( * ) Notice: Subject to any disclaimer, the term of this patent is extended or adjusted under 35 U.S.C. 154(b) by 0 days.

(21) Appl. No.: 15/093,977

(22) Filed: Apr. 8, 2016

(65) Prior Publication Data

US 2016/0300518 A1 Oct. 13, 2016

Related U.S. Application Data

(60) Provisional application No. 62/145,227, filed on Apr. 9, 2015.

(51) Int. Cl.
*G09G 3/00* (2006.01)

(52) U.S. Cl.
CPC ..... *G09G 3/006* (2013.01); *G09G 2360/145* (2013.01)

(58) Field of Classification Search
CPC ..... G09G 3/006; G09G 2360/14; G09G 2360/145; G09G 2320/0693
See application file for complete search history.

(56) References Cited

U.S. PATENT DOCUMENTS

| | | | | |
|---|---|---|---|---|
| 6,784,995 | B2 | 8/2004 | Merle et al. | |
| 9,286,818 | B2 * | 3/2016 | Asanuma | G09G 3/006 |
| 2015/0213771 | A1 * | 7/2015 | Ohnishi | G01J 3/46 345/88 |
| 2015/0243249 | A1 * | 8/2015 | Nagashima | G09G 5/02 345/589 |

* cited by examiner

*Primary Examiner* — Antonio A Caschera
(74) *Attorney, Agent, or Firm* — Leason Ellis LLP

(57) ABSTRACT

The present invention is directed to systems and methods to implement improved and more accurate measurements of the color display characteristics of a display device under analysis. Specifically, the apparatus and method of the present invention are configured to reduce the amount of off-axis light in such a way as to limit the impact of such light on the measurement of color values generated by the display device. The reduction is achieved by causing the display to emit a target radiation only the size and shape of the active area of the sensor.

20 Claims, 4 Drawing Sheets

METHOD AND SYSTEM FOR OBTAINING COLOR MEASUREMENT OF A DISPLAY SCREEN

CROSS REFERENCE TO RELATED APPLICATION

The present application claims the benefit of U.S. patent application Ser. No. 62/145,227, filed Apr. 9, 2015, which is hereby incorporated by reference in its entirety.

FIELD OF THE INVENTION

The present invention relates to a system and method for analyzing the light emitted by a display screen by providing a target area on a display device having the same dimensions as a light sensor used to analyze the display device so as to minimize the effects of off-axis light.

BACKGROUND OF THE INVENTION

Devices and methods for examining the properties and conditions of display devices are known in the art. Generally, these devices, such as colorimeters, are placed in close proximity to the screen of the display device and utilize a sensor to analyze the light characteristics emitted by the display screen, such as the color. However, to obtain the most accurate measurement of the light emitted by the display screen, the sensor should be positioned to directly observe pixels comprising a defined target area of the display. This means receiving light into the colorimeter that is along the normal to the display screen (such light being called on-axis light, and other light being called off-axis light). For a liquid-crystal display (LCD), light is emitted at all viewing angles so that a colorimeter with a non-selective viewing geometry will observe light that is not completely correlated with the directly-viewed light from the picture elements (pixels). As an example of this phenomenon, when LCDs are viewed off axis, lighter colors are produced when the display is commanded to produce dark colors.

Thus, off-axis light alters the measurements of a light sensing device by producing a higher recorded light value than can be attributed to the light emitted by the directly observed pixels. To correct this false positive, prior art solutions focus on preventing off-axis light from reaching the light sensor. For example, U.S. Pat. No. 6,784,995 describes using a black baffle with narrow holes to conduct only light in a selected direction so as to reduce off-axis light contamination. Alternatively, X-Rite's I1 Display Pro®, manufactured by X-Rite of Grand Rapids, Mich., diminishes off-axis light by introducing a lens that conducts light only from a preferred direction.

However, in both of these examples, additional hardware is needed to reduce the influence of off-axial light on the measurements. Thus, what is needed is a system and method to reduce off-axis light when measuring the light characteristics of a display without requiring additional hardware in the light sensor.

SUMMARY OF THE INVENTION

In accordance with a broad aspect of the present invention the system and method described are directed to reducing the amount of off-axis light in such a way as to limit the impact of such light on the measurement of color values generated by the display device without the use of additional hardware.

In more particular aspects, the present invention provides a system and method for calibrating a display device comprising an array of pixels using a measurement device having a processor, a memory, a sensor having a known sensor area (such as calculated by the length and width of the sensor device) and configured to output a measurement value corresponding to the light measured by the sensor, a connection to the display device, and a calibration and measurement application stored in the memory and executable by the processor. More particularly, the invention includes the step of positioning the sensor to receive light displayed by the display device and generating a target image at a location on the display device, wherein the target image is generated by causing a contiguous collection of pixels to emit a first light intensity, while the remaining pixels of the display device emit a second light intensity. The total area of the contiguous collection of pixels is equal or less than the sensor area. Also the shape of the collection of pixels is matched to the active area of the sensor. Thus, the collection of pixels will have the same dimensions as the active area of the sensor. The location of the target image on the display and the measurement value obtained by the sensor are stored in a memory location for retrieval and use by the processor.

To appose the target image with the sensor, the target image is moved to a new location on the display, while the sensor remains at the original location. A new measurement value is obtained from the sensor when the target image is placed at the new location, and the value is also recorded. This adjustment and measurement are repeated until the location of the target image when placed in direct view of the sensor is determined. This optimal location for the target image, i.e. where the target is directly observable by the sensor, can be determined by comparing the measurement values obtained at each location and identifying the maximum recorded light value across all the measured locations of the target. Once the location corresponding to the maximal measurement value is determined, the pixels corresponding to that location are used to analyze the light and color characteristics of the display.

BRIEF DESCRIPTION OF THE DRAWINGS

The foregoing and other features of the present invention will be more readily apparent from the following detailed description and drawings of an exemplary embodiment of the invention in which.

DESCRIPTION OF ILLUSTRATIVE CERTAIN EMBODIMENTS OF THE INVENTION

By way of overview and introduction, the present invention concerns a system and method to achieve accurate measurement of the display characteristics of a display device under analysis. Specifically, the system and method of the present invention are configured to reduce the amount of off-axis light received by the sensor in such a way as to limit the impact of such light on the measurement of color values generated by the display device.

In a particular arrangement, a light sensor is secured to the screen of the display device and configured to observe on-axis light emitted by the pixels in that specific area. A processor connected to the display device generates a test image to be displayed on the screen of the display device. This test image occupies an area of the display device that is equal to or less than the active sensor area of the light sensor. Additionally, the remaining portions of the display are configured to display a color, pattern or light intensity that is different than the one used to generate the test image.

This test image is displayed at different areas of the screen by activating different pixels of the display. At each area, a measurement is obtained of the pixels directly observed by the light sensor. When the pixels displaying the test image are the same pixels directly observed by the sensor, the light sensor will record a change in the measurement values. This area is stored and all of the pixels within this area are used by the light sensor to measure on-axis light, while the remaining pixels of the display are configured to emit low light or a dark color. Thus, an evaluation of the on-axis light, without the off-axis light contamination is conducted.

Figure 1:
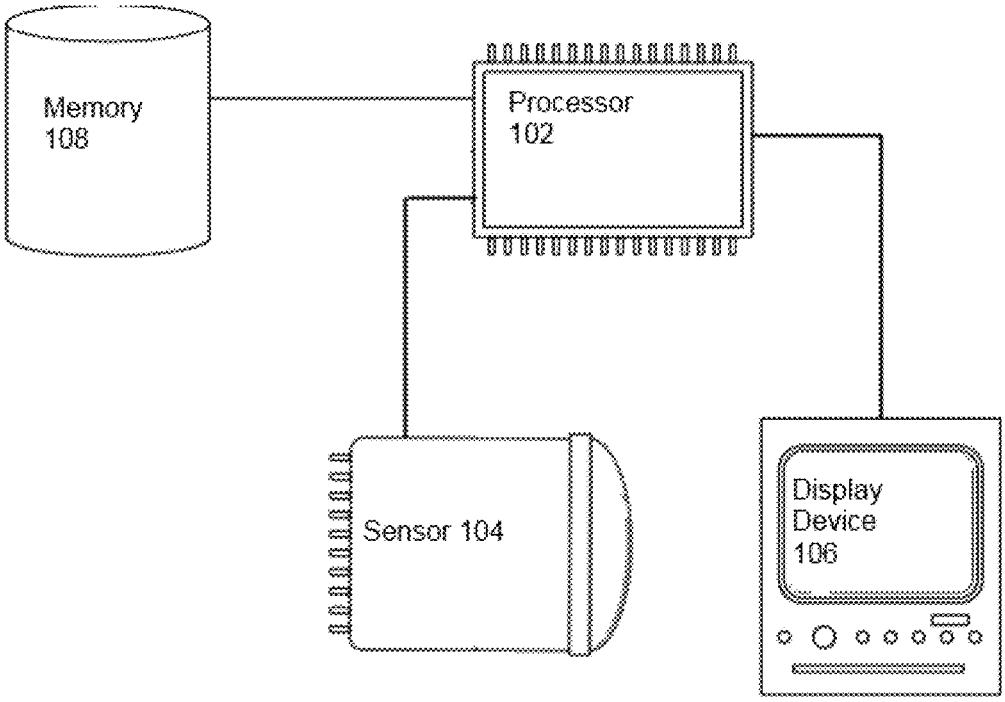
FIG. 1 is a schematic diagram detailing various components of an embodiment of the present invention.

Turning to the schematic provided in FIG. 1, the system described includes examples of the components utilized to generate the test patch having the same dimensions as the active sensing area of a light measurement device and obtain a substantially on-axis light measurement of the display device. The system utilizes a light measurement device 104 having a sensor with an active sensing area of known dimensions and configured to output a signal in response to light incident of the sensor. For example, the sensor area of a sensor having a known length and width can be calculated. Likewise, in one or more arrangements, the shape and size of the sensor or the active foot print of the sensor, is known. In one arrangement the light measurement device 104 is a colorimeter. More particularly, the colorimeter is a tristimulus colorimeter used in digital imaging, and is configured to profile and calibrate output display devices. In a particular implementation, the light measurement device 104 is configured to obtain wideband spectral energy readings along the visible spectrum. For example, the light measurement device 104 measures the intensity of the light in addition to the color (relative spectrum) of the light.

In one non-limiting example, the light measurement device 104 is configured with a direct connection to a computer, such as the processor 102. In the alternative, the light measurement device 104 is equipped with a wireless communication device (not shown) that allows for transmission of output values to a computer or processor 102.

The sensor utilized by the light measuring device 104 is, in one arrangement, a chip colorimeter such as the Ams® TCS3414 sensor manufactured by ams AG (formerly known as austriamicrosystems), headquartered in Styria, Austria. Such a colorimeter has a small sensor area (a few square millimeters) and therefore gives advantage to the present teaching of a sensor-area-limited test target for a display colorimeter system. However, any number of commercially available or custom light sensing elements can be used in the illustrated embodiments. Sensor devices and associated hardware and software, such as active pixel sensors, charged coupled device (CCD) sensors, or other photodetector elements that have suitable characteristics and features necessary to implement the actions described herein are also envisioned. In one or more embodiments, the shape, size or dimensions of the active sensor of the light sensor is known and provided to the computer or processor 102.

Figure 2:
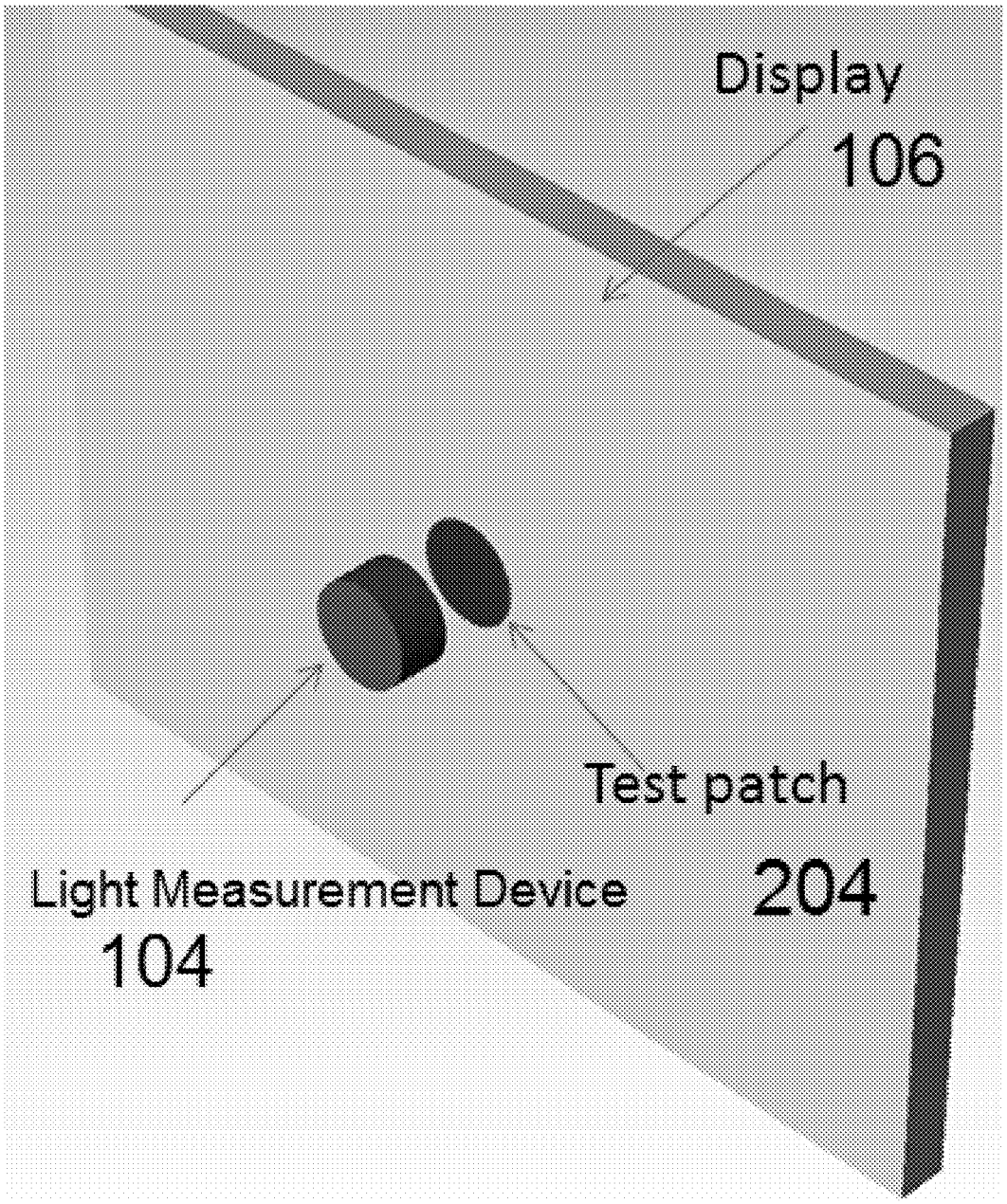
FIG. 2 is a perspective view of the sensor and display elements of the system described.

As shown in FIG. 2, the light sensor 104 is placed over a portion of the screen of a display device 106 and is orientated so the direct on-axis light from the display device will be incident on the sensor. Thus, the measurement device 104 is configured to output a signal or value that corresponds to a measured value of the light emitted by the pixels under direct observation.

Returning to FIG. 1, the display device 106 is any display device that utilizes discrete display elements, such as pixels or pixel equivalent elements that allow for the generation of different colors, hues or light intensities. More specifically, the display device 106 is configured to generate images on a screen or display surface by controlling the color, hue and intensity of the light generated by each pixel. In particular arrangements, the display includes an integrated or dedicated processor that receives instructions in the form of data and implements direct control over the pixels of the display. In one further embodiment, the display device 106 is a LED or LCD screen.

The processor 102 is configurable by code stored within the memory 108 and is able to execute instructions and process data. For example, the processor 102 is a general purpose microprocessor configured to execute instruction in the form of software applications. The processor 102 of the present embodiment is a desktop, notebook or tablet computer equipped with standard connections to the display device 106. In one non-limiting embodiment, the processor 102 is configured with inputs, such as USB, FIREWIRE, eSATA, or other direct data connections. Here, the light measurement device 104 utilizes an input interface to connect with the processor 102. However, as described with respect to the light measurement device 104, the inputs and outputs can, in one configuration, be wireless data communication devices. The processor 102 is configured to receive data from the light measurement device 104, process that data and generate outputs. In one such arrangement, the output of the processor 102 is control data configured to control the images depicted on the display device 106. For example, the processor 102 in one arrangement is configured to output data providing instructions to the display device 106 detailing particular colors or intensities to be generated by a member of the pixel array.

With reference to the processor 102, the processor includes memory which is coupled to the processor(s). The memory may be used for storing data, metadata, and programs for execution by the processor(s). The memory may include one or more of volatile and non-volatile memories, such as Random Access Memory ("RAM"), Read Only Memory ("ROM"), Flash, Phase Change Memory ("PCM"), or other type. In one or more embodiments, the processor includes a display controller to directly send signals to the display device.

In a further arrangement, the processor 102 also includes one or more wireless transceivers, such as an IEEE 802.11 transceiver, an infrared transceiver, a Bluetooth transceiver, a wireless cellular telephony transceiver (e.g., 1G, 2G, 3G, 4G), or another wireless protocol to connect the data processing system with another device, external component, or a network. In addition, Gyroscope/Accelerometer devices and functionality can be provided.

Figure 3:
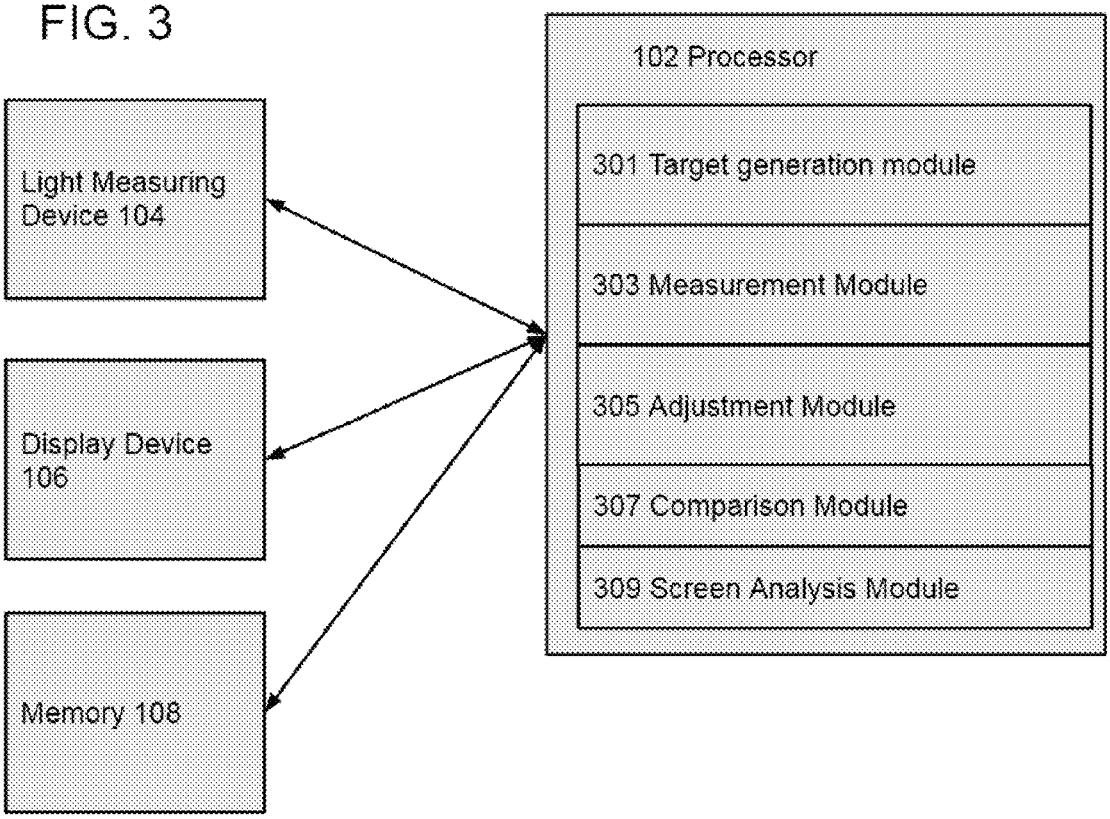
FIG. 3 is a block diagram of an exemplary system in accordance with an embodiment of the present invention.
Figure 4:
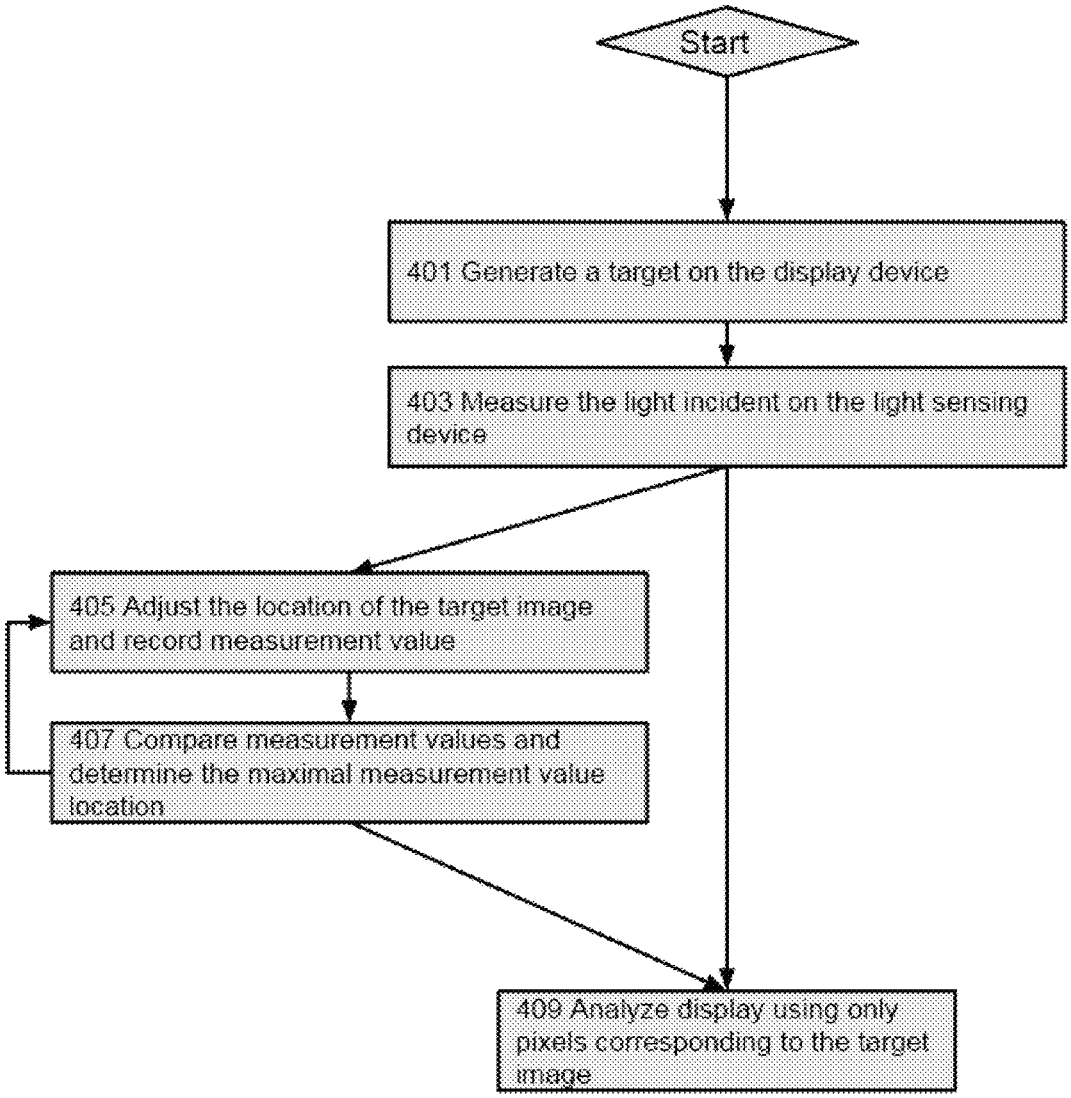
FIG. 4 is a flow diagram detailing the steps of an embodiment of a method described herein.

As provided in FIGS. 3 and 4, a series of programmed steps performed by a properly configured computer system using one or more modules of computer-executable code can be used to implement the tasks of the processor. For instance, a set of software modules can be configured to cooperate with one another to configure the processor 102 so that when executed, they provide a target image having the same dimensions as the active sensor of the light measurement device 104 and adjusted so that the target image 204 is located in the area of the display under observation by the color measurement device 104. The processor 102 is further configured by modules to access data from the light measurement device 104 and to send instructions to the display device 106 enabling the display to provide a target image 204.

In one arrangement, the target image 204 is produced by a target generation module 301 configured as code or an application executing in the processor 102 and stored in the memory device 108, as in step 401 of FIG. 4. As shown in FIG. 2, the image target or test patch 204 is generated on the display device 106 and, in one arrangement, is configured such that the area of the screen occupied by the target image 204 is equal or less than the active sensing area of the light sensor of the light measurement device 104. Thus, the dimensions of the target image 204 are equal to the active sensing area of the light sensor of the light measurement device 104.

In a particular configuration, the target image is brighter than the remaining display. For instance, the target image is composed of pixels generating a white color occupying an area equal to or less than the sensor area, while the remaining pixels provide a different color, such as black. Alternatively, the target image is comprised of an alternating pattern. In this arrangement, the alternating pattern displayed has dimensions such that the light measurement device is capable of sensing the entire pattern. In a further implementation, the target image 202 is generated in a first color or hue, while the remaining pixels of the display provide a second color or hue.

Once the target image is generated, a measurement is taken of the area observed by the light measurement device 104 utilizing a measurement module 303, as shown in step 403. This measurement value is related to the light emitted by the screen at the location where the light sensing device is placed over the screen. It should be noted that the light sensor can be placed at any preferred location over the screen of the display device 106.

In one arrangement, in the event that the target image 204 is displayed in the area of the display device 106 completely observed by the light measurement device 104, the processor 102 then implements a calibration or analysis protocol using module 309, as shown in step 409. However, in other instances, the target image 204 is displayed in an area of the display device not completely observed by the light sensor 104.

In the event that the target image is not produced in the area of the screen observed by the light measurement device 104, as determined by an output signal indicating that the total area of the sensor is receiving the light related to the total target image, the processor 102 repeatedly adjusts the placement of the target image 204 using an adjustment module 305 until the image is displayed in the area observed by the light sensor 104.

As shown in step 405, the adjustment of the target image 204 is conducted iteratively or linearly, and is implemented by changing the output of different pixels to display the target image 204 at different locations on the display device 106 while the measuring device 104 remains stationary. At each new location of the target image, a measurement of the light received by the light measurement device 104 is taken and stored in the memory 108. Thus, a measurement of the light received by the stationary light measurement device 104 is associated with each location that the target image 204 is displayed. This adjustment and measurement process is repeated until the target image 204 is displayed in a plurality of possible locations on the display device 106.

However, in an alternative configuration, the processor 102 implements a binary search algorithm to iteratively place the target image in the area observed by the light sensor. In another configuration, the processor 102 is configured to implement an interpolation search or linear search algorithms to provide an optimized search strategy to place the target image 204 in the area directly observed by the light measurement device 104.

In one particular implementation of the system described, the processor is configured to implement a search algorithm that progressively divides the screen into sections to determine the section closet to the sensor. For example, the processor 102 is configured by one or more modules, or sub-modules, to divide the screen into four (4) quadrants. The processor is further configured to successively or sequentially set the pixels contained within each quadrant to a specific color or intensity. In this way the measurements obtained by the light measurement device 104 are used to narrow down the location of the light measurement device 104 to one of the quadrants. Successive divisions of the identified quadrant are, in a further implementation, used to refine the position of the light sensing device.

Alternatively, one or more search algorithms are used in conjunction with one another, such that the pixels in a identified quadrant are then searched using a binary search algorithm.

In one implementation of a search or placement strategy, the processor 102 compares each received measurement value corresponding to a specific target image 204 location to a pre-set expected measurement value. This expected measurement value corresponds to the anticipated measurement values produced by the light measurement device 104 when the target image 204 is placed in the area directly observed by the light measurement device 104. According to this strategy, the processor 102 ceases the adjustment of the target image 204 upon receiving measurement values from the light measuring device 104, and correlating the measured values to the expected measurement and the results of the comparison are within a given range. Alternatively, the processor 102 is configured to direct the adjustment of the target image in response to the received measurement value, such that an optimal path to the anticipated proper placement is implemented. As an alternative approach, if a portion of the image target 204 is observed by the light measurement device 104, then the processor 102 is configured to adjust the placement of the target image such that it is moved to the area under observation.

In still a further implementation, the processor 102 is configured to alter the size and shape of the image target 204 in response to the measurements obtained by the light measuring device 104. Thus, in embodiments having an image target 204 area smaller or larger than the observable area of the light measuring device 104, the image target is modified such that there is the closest matching possible of the respective areas. As an example, the processor 102 is configured to determine the size of the light sensor based on the received readings measured when the image target is placed beneath and in close proximity to the light measurement device. In a particular embodiment the size and shape of the target image 204 is such that the target image functions to collimate the light emitted from the display through to the sensor element of the light measuring device 104.

Depending on the techniques used to adjust the placement of the target image 104, the processor 102 is further configured by a comparison module 307 which configures the processor 102 to implement a comparison of the measurement values obtained at each location and determine the optimal location to display the target image in order to obtain the most complete observation of the target image, as in shown in step 407. In one arrangement, this comparison looks at the highest average luminosity recorded by the light measurement device 104 and the corresponding location where the target image was placed. Alternatively, the comparison looks at the color average or tristimulus value averages for each location and determines the optimal location based on stored data about the color of the target image and the remaining pixels.

In one implementation, once the optimal image location is identified, the pixels corresponding to that location are used by the light sensor to conduct an analysis of the screen of the display device, while the remaining pixels of the display are configured to produce a minimal amount of off-axial light. Thus, the only light striking the light sensor of the light measurement device 104 will be on-axis light from the pixels directly observed by the light measurement device 104.

The present invention also incorporates a method of using the system described to carry out and achieve the function of analyzing a display device by reducing the introduction of off-axis light by constraining the area of the display screen producing the measured qualities to an area that is equal to or less than the active area of the sensor. Such a method involves, but is not limited to, a positioning step, wherein a light sensor is positioned to observer a portion of the display device. The method includes a generating step where a target image is generated on a display device, the target image having dimensions such that the entire target image is observable by the sensor of the light measurement device. A measuring step is provided, where the light measurement device 104 measures the received light from the display device 106. An adjustment step is provided where the target image is displayed at different locations on the display device and a new measurement is obtained and associated with the location of the target image. After the target image has been displayed at a number of locations on the display device, a comparison step compares the measurements taken by the light measuring device and determines an optimal calibration location where the complete target image will be observed by the light sensor.

Once the optimal calibration location is determined, the pixels observed by the light measuring device are measured and used as input for a display analysis step. The display analysis step can include calibrating or customizing the light, hue tone or other features of the display device.

Each of the forgoing modules can be configured as a series of discrete sub-modules designed to access and control the light sensing device, the pixels array of the display device, memory devices and output devices. Each of these modules can comprise hardware, code executing in a processor, or both, that configures a machine, such as the computing system, to implement the functionality described herein. The functionality of these modules can be combined or further separated, as understood by persons of ordinary skill in the art, in analogous implementations of embodiments of the invention.

It should be understood that various combination, alternatives and modifications of the present invention could be devised by those skilled in the art. The present invention is intended to embrace all such alternatives, modifications and variances that fall within the scope of the appended claims.

While the invention has been particularly shown and described with reference to a preferred embodiment thereof, it will be understood by those skilled in the art that various changes in form and details may be made therein without departing from the spirit and scope of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It should be noted that use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Particular embodiments of the subject matter of the present invention have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain embodiments, multitasking and parallel processing can be advantageous.

Unless the context clearly requires otherwise, throughout the description, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

Publications and references to known registered marks representing various systems are cited throughout this application, the disclosures of which are incorporated herein by reference. Citation of the above publications or documents is not intended as an admission that any of the foregoing is pertinent prior art, nor does it constitute any admission as to the contents or date of these publications or documents. All references cited herein are incorporated by reference to the same extent as if each individual publication and references were specifically and individually indicated to be incorporated by reference.

The above description of embodiments of the present invention are not intended to be exhaustive or to limit the systems and methods described to the precise form disclosed. While specific embodiments of, and examples for, the apparatus are described herein for illustrative purposes, various equivalent modifications are possible within the scope of other articles and methods, as those skilled in the relevant art will recognize. The teachings of articles and methods provided herein can be applied to other devices and arrangements, not only for the apparatus and methods described above.

The elements and acts of the various embodiments described above can be combined to provide further embodiments. These and other changes can be made to the apparatus and methods in light of the above detailed description.

What is claimed is:

1. A computer-implemented method to obtain at least one color measurement value related to light displayed by a display device comprising an array of pixels using a measurement device having a processor, a memory, a sensor positioned to receive light displayed by the display device having a known sensor area and configured to output a measurement value corresponding to the light measured by the sensor; a connection to the display device, and a calibration and measurement application stored in the memory and executable by the processor, the method comprising:

generating a target image at a location on the screen of the display device, wherein the target image is generated by causing a contiguous collection of pixels to emit a first light intensity, while the remaining pixels of the display device emit a second light intensity, the total area of the contiguous collection of pixels being equal or less than the sensor area;

storing the location of the target image on the display device and the measurement value obtained while the target image is at that location;

adjusting the placement of the target image to a new location and repeating the storing step;

comparing the measurement values obtained at each location and identifying a maximal measurement value location corresponding to the highest recorded measurement value;

moving the placement of the target image to the maximal measurement value location; and obtaining at least one additional measurement of the light emitted by the display at the maximal measurement value location.

2. The method of claim 1, wherein the sensor is a sensor array comprised of a plurality of digital light sensing elements.

3. The method of claim 1, wherein the first light intensity is greater than the second light intensity.

4. The method of claim 1, wherein the target image is a pattern of alternating light intensities.

5. The method of claim 1, wherein the target image is a monochromatic image.

6. The method of claim 1, wherein the adjustment step implements a search algorithm to determine the next position of the test image.

7. The method of claim 1, wherein the search algorithm is selected from a binary search, interpolation search or linear search algorithm.

8. The method of claim 4, wherein the adjustment step further includes:

comparing the received measurement value to a stored expected measurement value, and terminating the adjustment step when the received measurement value is within a pre-set range of the stored expected measurement value.

9. The method of claim 4, wherein the adjustment step further includes:

estimating the maximal measurement value location by comparing the measurement values obtained at prior target image locations and comparing the values to a stored expected measurement value.

10. The method of claim 1, wherein the movement step further includes:

altering the dimensions of the target image when positioned in the maximal measurement value location;

determining a maximal size sensor area of the sensor based on the altered size of the target image.

11. The method of claim 1, wherein the adjustment step further includes:

adjusting the dimensions of the target image such that only collimated light is incident upon the sensor.

12. The method of claim 1:

wherein the display device is a light emitting diode or liquid crystal display.

13. The method of claim 1:

wherein the shape and side of an active sensor footprint of the sensor is known.

14. A system for obtaining at least one color measurement value related to light displayed by a display device comprising:

a light measurement device having a sensor of a known sensor area and configured to output measurement values corresponding to light incident upon the sensor;

a display with a screen comprising an array of pixels;

a processor configured to access a memory device, the output of the light measurement device and the display device, where the processor is further configured to generate a target image at a location on the display device, wherein the target image is generated by causing a contiguous collection of pixels to emit a first light intensity, while the remaining pixels of the display device emit a second light intensity, the total area of the contiguous collection of pixels being equal or less than the sensor area, store the location of the target image on the display device and the measurement value obtained while the target image is at that location; adjust the placement of the target image to a new location; compare the measurement values obtained at each location and identifying a maximal measurement value location corresponding to the highest recorded measurement value; move the placement of the target image to the maximum measurement value location; and obtain at least one additional measurement of the light emitted by the display at the maximal measurement value location.

15. The system of claim 14 wherein:

the processor is further configured to adjust the size of the target image such that only collimated light is incident upon the sensor of the light measuring device.

16. The system of claim 15:

wherein the display device is a light emitting diode or liquid crystal display.

17. A display calibration device comprising:

a light measurement sensor positioned to receive light from a portion of a display device, the sensor configured to output measurement values corresponding to light incident upon the sensor;

a processor and memory, where the processor is configured to access a memory device, and receive input from the light measurement sensor and output signals to a display device connector;

where the processor is configured by code executing therein as a series of modules to output a display signal to the display device connected to the display device connection that causes the display device to generate a target image on the display device, the target image being a contiguous collection of pixels to emitting a first light intensity that is different from the light emitted by the remaining pixels of the display device; the processor further configured to adjust the placement of the target image on the display device until the target image is placed in the portion of the display device that the light measurement sensor is positioned to receive light from, and obtain at least one additional measurement of the light emitted by the display at the maximal measurement value location.

18. The apparatus of claim 17, wherein the processor is configured to implement a search algorithm to determine where to adjust the position of the test image.

19. The apparatus of claim 17 wherein:

the processor is further configured to adjust the size of the target image such that only collimated light is incident upon the sensor of the light measuring device.

20. The apparatus of claim 17:

wherein the display device is a light emitting diode or liquid crystal display.

* * * * *